US010124460B2

(12) United States Patent
Stagni

(10) Patent No.: US 10,124,460 B2
(45) Date of Patent: Nov. 13, 2018

(54) SANDING MACHINE

(71) Applicant: E.M.C. S.r.l., Imola (Bologna) (IT)

(72) Inventor: Alberto Stagni, Imola (IT)

(73) Assignee: E.M.C. S.R.L., Imola (Bologna) (IT)

( * ) Notice: Subject to any disclaimer, the term of this patent is extended or adjusted under 35 U.S.C. 154(b) by 32 days.

(21) Appl. No.: 15/321,438

(22) PCT Filed: Jul. 8, 2015

(86) PCT No.: PCT/IB2015/055165
§ 371 (c)(1),
(2) Date: Dec. 22, 2016

(87) PCT Pub. No.: WO2016/005918
PCT Pub. Date: Jan. 14, 2016

(65) Prior Publication Data

US 2017/0165805 A1 Jun. 15, 2017

(30) Foreign Application Priority Data

Jul. 10, 2014 (IT) ..... BO2014A0392

(51) Int. Cl.
*B24B 21/08* (2006.01)
*B24B 27/00* (2006.01)

(52) U.S. Cl.
CPC ..... *B24B 21/08* (2013.01); *B24B 27/0015* (2013.01); *B24B 27/0069* (2013.01); *B24B 27/0084* (2013.01)

(58) Field of Classification Search
CPC ..... B24B 21/08; B24B 27/00; B24B 27/0015; B24B 27/0069
USPC ..... 451/300, 301, 303, 299, 59
See application file for complete search history.

(56) References Cited

U.S. PATENT DOCUMENTS 2,762,173 A * 9/1956 Bottcher ..... B24B 21/00 451/300
4,038,784 A * 8/1977 Grivna ..... B24B 7/12 144/356
7,371,159 B2 5/2008 Kundig

FOREIGN PATENT DOCUMENTS

DE 1995881 U 10/1968
DE 3029591 A1 3/1981
EP 0225296 A1 6/1987
WO WO0202270 A1 1/2002
(Continued)

OTHER PUBLICATIONS

International Search Report dated Oct. 21, 2015 from counterpart PCT App No. PCT/IB2015/055165.

*Primary Examiner* — Robert Rose
(74) *Attorney, Agent, or Firm* — Shuttleworth & Ingersoll, PLC; Timothy Klima

(57) ABSTRACT

A sanding machine for sanding panels, including a supporting structure, a sanding unit supported by the supporting structure, a surface for supporting and sliding of the panels located beneath the sanding unit and along which the panels are fed in a predetermined feed direction; the sanding unit including a trestle supporting a sanding belt, the trestle including a plurality of rollers having respective axes parallel to the supporting surface, the sanding belt being endless and looped around the rollers, one of the rollers being motorized to move the sanding belt during the sanding of the panels, the sanding unit further including at least one opposing member to force the belt against the panel to be sanded.

12 Claims, 6 Drawing Sheets

(56) References Cited

FOREIGN PATENT DOCUMENTS

WO WO2004009290 A1 1/2004

* cited by examiner

SANDING MACHINE

This application is the National Phase of International Application PCT/IB2015/055165 filed Jul. 8, 2015 which designated the U.S.

This application claims priority to Italian Patent Application No. BO2014A000392 filed Jul. 10, 2014, which application is incorporated by reference herein.

TECHNICAL FIELD

This invention relates to a sanding machine.

The sanding machine performs the sanding operation required for a subsequent finishing step such as polishing, for example in the panels, either wooden or lacquered, for furniture or work surfaces.

BACKGROUND ART

In the case of wooden panels, for example, to prevent the grain of the wood being visible after painting, it is important to carry out a careful sanding, sometimes also defined as super-finishing when its results approach those obtained with polishing.

Even with materials other than wood, such as for example Corian® or the like, which is frequently used in the preparation of kitchen worktops, it is necessary, after the sanding operation, in order to eliminate any small dips produced during that step, to carry out by hand a finishing step using hand tools.

Belt sanding machines are normally used in order to carry out this surface finishing of the panels, wherein, precisely in known manner, an abrasive belt is looped around suitable rollers for moving around them and engaging in sliding contact with the surface of a panel for modifying the appearance.

During the looped rotation of the belt about the relative drive and operating rollers the panel, normally located beneath the belt, is in turn moved along a rectilinear direction at a predetermined speed in such a way as to engage with the abrasive belt for a predetermined length of time.

The belt sanding machines of known type are not without drawbacks.

In effect, in the prior art belt sanding machines, considering a generic point of the surface of a panel, during the movement of the panel through the machine it normally engages with the belt having a peripheral speed parallel to that of panel itself.

This circumstance implies that with an imperfection present on the belt, the repeated passing over the same part of the panel can generate undesired alterations to its surface continuity, such as, for example grooves or lines.

A further drawback linked to the use of prior art sanding machines is that it is not possible to effectively process, with homogeneous results, panels or other elements consisting of wooden parts having different grain orientations, such as, for example, frames of doors and windows or the like. In fact, considering for example a wooden window, this has slats positioned at right angles to each other which, when they engage with the sanding belt are conditioned differently: the portions with a grain orientation parallel to the feed direction of the belt will in effect be more worn by the abrasive action of the belt than those with a grain orientation at right angles. This disparity of the effects makes manual sanding of the products suitable with consequent increases in the production times and costs.

There are prior art sanding machines wherein the trestle supporting the sanding belt can be oriented about a vertical axis in such a way that the feed direction of the belt is inclined at a predetermined angle relative to the feed direction of the panel being processed.

Examples of such machines are illustrated in patents WO 2004/009290 and DE 1 995 881.

DISCLOSURE OF THE INVENTION

The aim of this invention is to provide a sanding machine for sanding panels which overcomes the above-mentioned drawbacks of the prior art.

More specifically, the aim of this invention is to provide a sanding machine which is able to maximize the uniformity of surface finishing of the panels.

A further aim of this invention is to provide a sanding machine which is effective and practical to operate and simple and inexpensive to maintain.

Another aim of this invention is to provide a sanding machine which is practical and economical to make.

This invention accordingly provides a sanding machine comprising the features as disclosed herein.

BRIEF DESCRIPTION OF DRAWINGS

The technical features of the invention, with reference to the above-mentioned aims, can be easily inferred from the present disclosure.

The advantages of the invention are more apparent from the detailed description which follows, with reference to the accompanying drawings which illustrate a embodiment, non-limiting example embodiment of the invention and in which.

DETAILED DESCRIPTION OF PREFERRED EMBODIMENTS OF THE INVENTION

Figure 1:
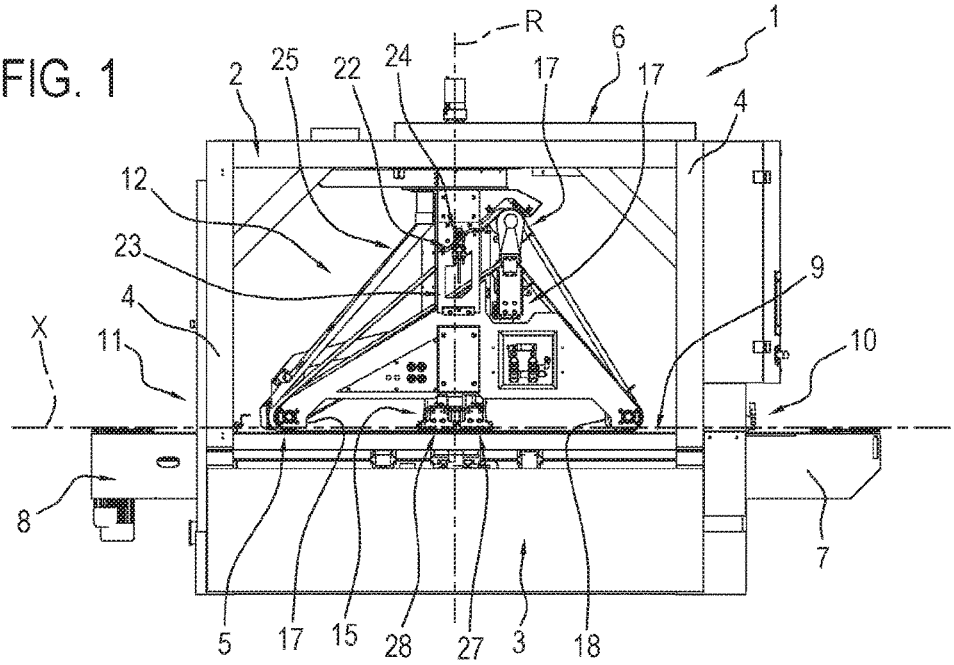
FIG. 1 is a schematic side elevation view of a sanding machine for sanding panels made according to this invention.

As illustrated in FIG. 1, the reference numeral 1 denotes in its entirety a sanding machine made according to this invention.

The machine 1 comprises a supporting structure 2 having an approximately parallelepiped shape.

The supporting structure 2 comprises a base 3 and four uprights 4 rising up vertically from the base 3.

The four uprights 4 are connected with each other by crosspieces 5 and an upper cover 6.

Again with reference to FIG. 1, the machine 1 has two projecting portions 7, 8 respectively a first and a second, supporting the panels, not illustrated, to be sanded.

In this description, the term panel does not limit the scope of the invention and comprises any object having an extension at least approximately flat, such as also slabs or laminates.

These first and second projecting portions 7, 8 extend in a cantilever fashion along a predetermined feed direction X of the panels inside the machine 1.

Between the portions 7, 8 the machine 1 comprises a substantially horizontal shelf 9, defining a supporting and sliding surface for the above-mentioned and not illustrated panels.

The shelf 9 advantageously comprises the upper branch of a conveyor belt of known type and not further described.

An inlet opening 10 is defined at the first projecting portion 7 for the entrance into the machine 1 of the panels which must be processed.

Similarly, at the second projecting portion 8 there is an opening 11 for exit from the machine 1 of the panels already subjected to the planned sanding.

The path travelled inside the machine 1 by the panels being processed between the two above-mentioned inlet and outlet openings 10, 11 defines a predetermined feed direction X of the panels.

The machine 1 comprises a sanding unit 12 supported by the mounting structure 2.

More specifically, the sanding unit 12 is connected, in a suspended fashion, to the cover upper 6.

The sanding unit 12 comprises a trestle 13 for supporting a sanding belt 14 and an opposing member 15 to force the belt 14 against the panel to be sanded and thereby exert its abrasive action.

The trestle 13 has the shape of a triangular prism with a relative lower rectangular face 13*a* positioned substantially superposed on the above-mentioned shelf 9 and designed to enter into contact with the panel.

Figure 3:
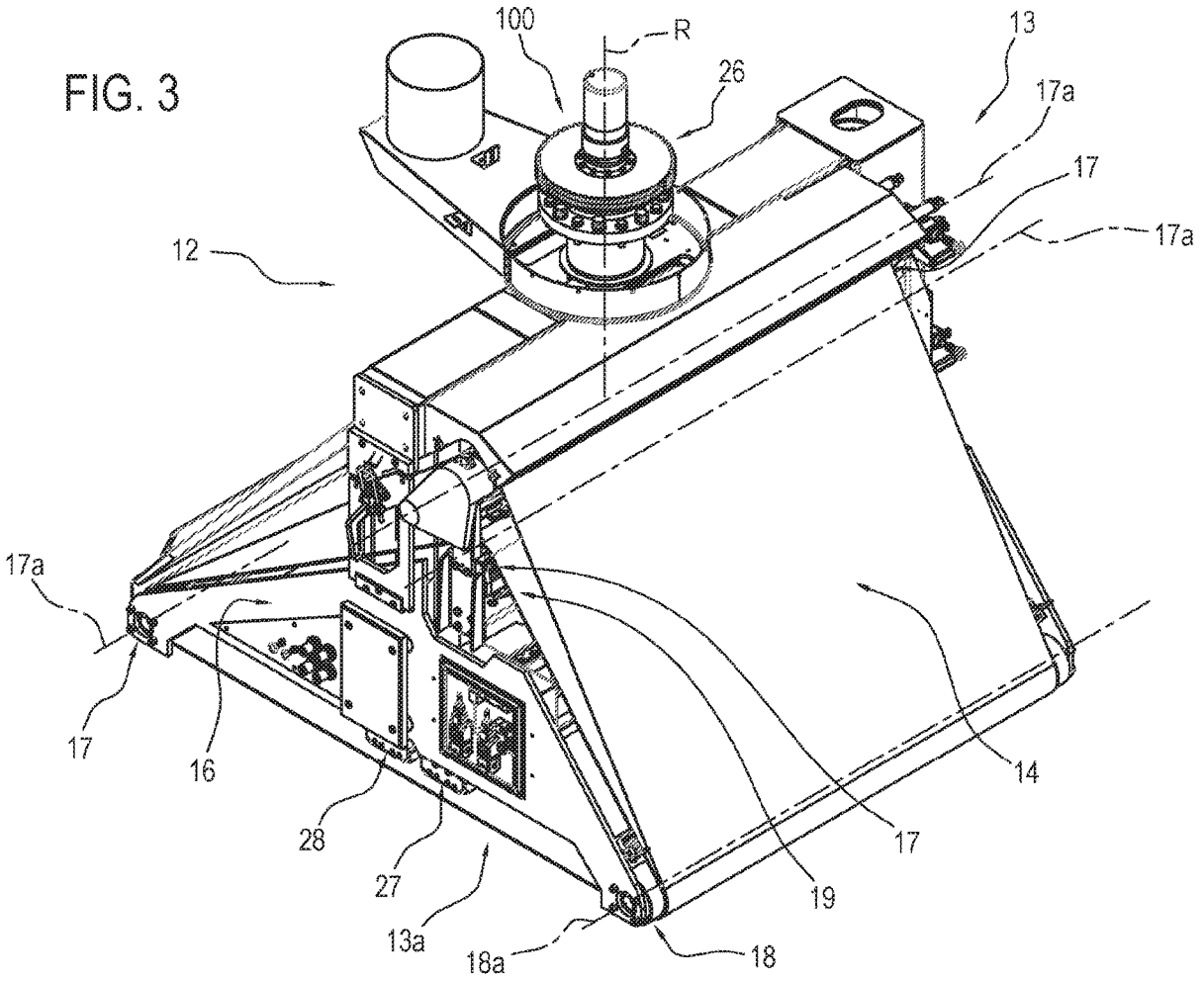
FIG. 3 is a schematic perspective view from above of a component of the machine of the previous drawings.
Figure 4:
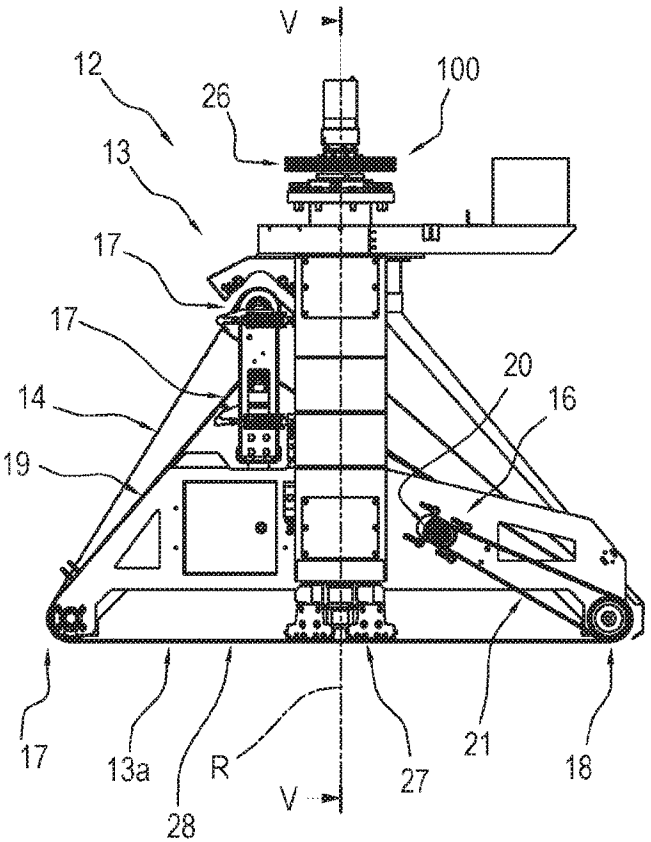
FIG. 4 is a schematic side elevation view of the component of FIG. 3.
Figure 6A:
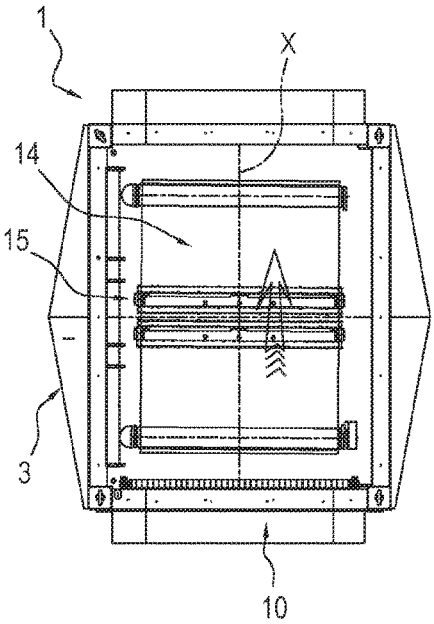
FIGS. 6*a* and 6*d* illustrate, in respective views from above, with some parts cut away and other parts transparent to better illustrate others, the machine shown in the previous drawings in four different operating moments.
Figure 6B:
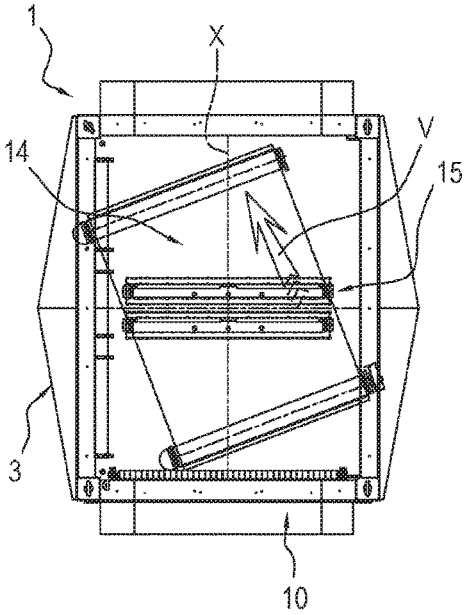
Figure 6C:
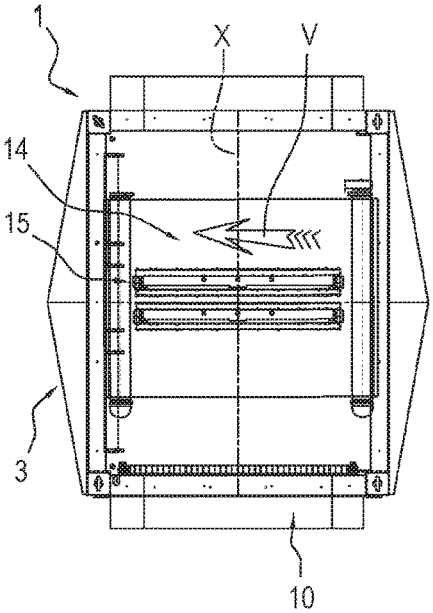
Figure 6D:
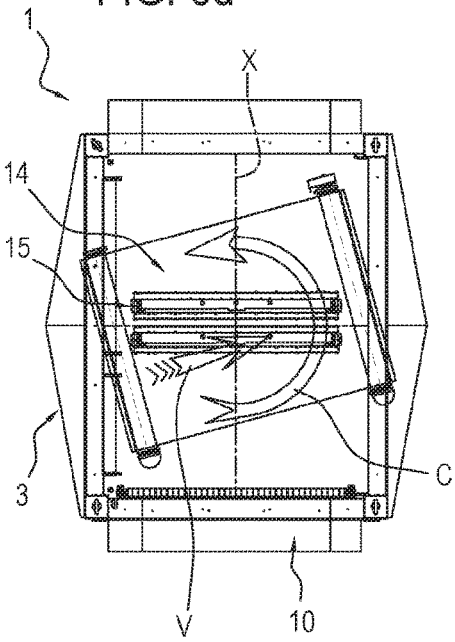

As illustrated in FIGS. 3 and 4, the trestle 13 comprises a frame 16 and a plurality of rollers 17, 18 about which are wound in a loop both the above-mentioned sanding belt 14 and the drive belt 19.

The drive belt 19 is wound inside the sanding belt 14 and is designed to transmit to it the movement generated by a motor-driven roller 18.

With reference to FIG. 4, the motor-driven roller 18 is rotated by an actuator 20 through a belt 21.

The drive belt 19 is advantageously made from material with a high friction coefficient, to guarantee an effective adhesion with the inner face of the sanding belt 14 and, consequently, an equally efficient drive, without jerking.

The return rollers 17 and motor-driven rollers 18 rotate about respective axes 17*a*, 18*a* parallel to each other.

Figure 5:
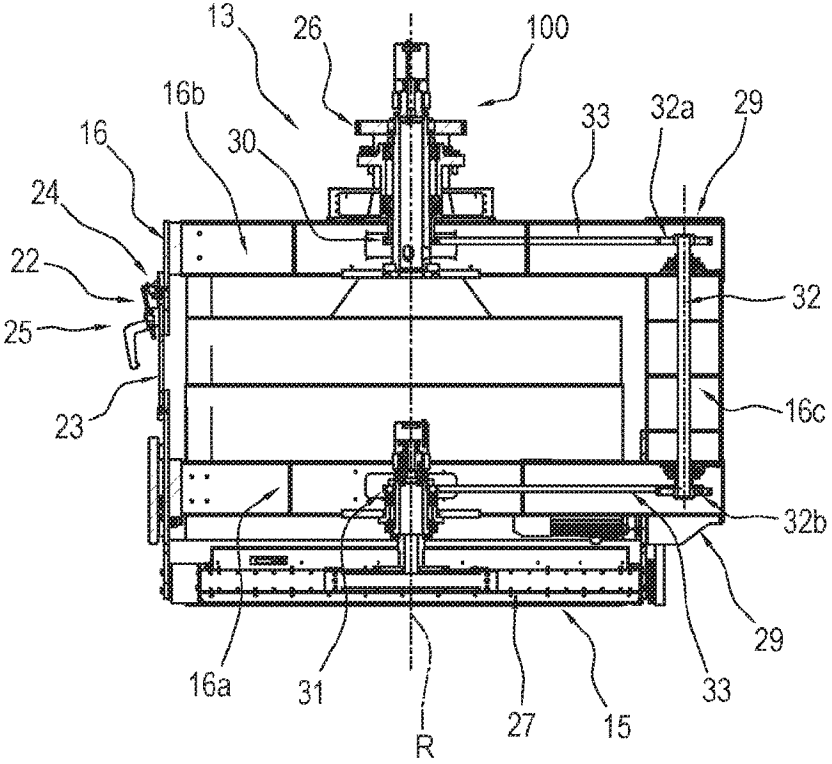
FIG. 5 is a cross section view through the line V-V of FIG. 4.

As illustrated in particular in FIG. 5, the frame 16 of the trestle 13 is C-shaped, with a arm lower 16*a*, an upper arm 16*b* and a connecting column 16*c* between the arms 16*a*, 16*b*.

The above-mentioned C-shape is designed to allow the insertion and extraction of sanding belts 14 shaped as a closed loop.

In view of the above description, in order to guarantee the necessary rigidity of the frame 16, the trestle 13 comprises a maneuverable fastening member 22 located on a plate 23 connected to one end of the lower arm 16*a*, and a hook 24 located on a corresponding upper arm 16*b*.

The hook 24 is designed to stably engage with the above-mentioned fastening member 22 to guarantee a stable relative position of the ends 16*a*, 16*b*.

In effect, in the absence of the stable connection, the cantilever ends of the arms 16*a*, 16*b* might, due to the bending induced by the forces acting on the trestle 13 during operation of the machine 1, modify their reciprocal distance thus adversely affecting the regularity of the sanding performed by the belt 14 on the above-mentioned and not illustrated panels.

The fastening member 22 together with the hook 24 defines, for the trestle 13, respective openable means 25 for connecting the lower and upper arms 16*a*, 16*b*.

The above-mentioned openable connecting means 25 also comprise respective adjustment means for adjusting the reciprocal distance between the above-mentioned end of the upper and lower arms 16*b*, 16*a*, along a direction parallel to the above-mentioned axis R.

Advantageously, the above-mentioned and not illustrated adjustment means comprise an adjustable screw element.

As mentioned, the sanding unit 12 is connected to the upper cover 6 and, in particular, the trestle 13 is rotatably connected to the cover 6, in such a way as to rotate relative to it about an axis R of rotation which is substantially vertical, at a right angle to the shelf 9 forming the above-mentioned supporting surface.

Figure 7:
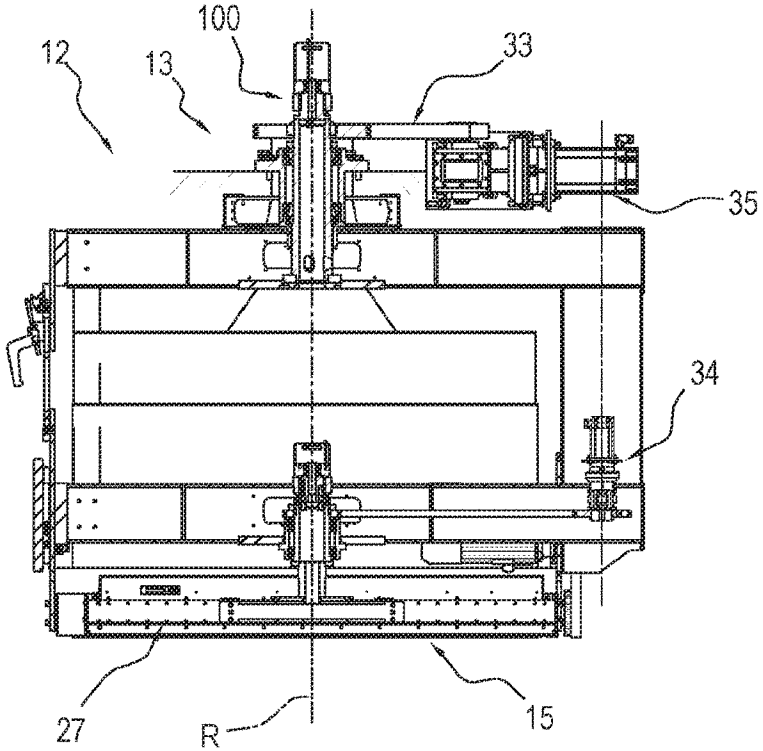

As illustrated in FIGS. 4 and 5, the trestle 13, in a relative upper portion, comprises a toothed pulley 26 designed to engage with flexible transmission units, not illustrated, for transmitting to the trestle 13 a rotational motion generated by a first electric motor, only illustrated in the variant embodiment of FIG. 7 and denoted by the reference numeral 35.

The above-mentioned first electric motor, together with the pulley 26 and the above-mentioned and not illustrated flexible transmission units, defines for the machine 1, respective motor means 100 for rotating, precisely, the trestle 13 about the axis R.

The motors mean 100 are configured to continuously rotate the trestle 13 about the perpendicular axis R in such a way as to rotate the belt 14 and control the relative motion (for processing) between the belt 14 and the panel being processed, as described in more detail below.

As illustrated in the accompanying drawings, the above-mentioned opposing member 15 comprises two shoes 27, 28 designed to push the sanding belt 14 against the above-mentioned and not illustrated panel to be processed.

The shoes 27, 28 are positioned transversely relative to the feed direction X of the panels, spaced apart from each other and relative to the axis of rotation R of the trestle 13.

In practice, the two shoes 27, 28 are located on opposite sides of the axis R of rotation, along the above-mentioned predetermined feed direction of the above-mentioned and not illustrated panels.

As clearly illustrated in FIG. 5, the opposing member 15 comprising the two shoes 27, 28 is rotatably connected to the trestle 13 at the lower arm 16*a* to rotate relatively to the axis R of rotation of the trestle 13.

The rotatable connection between the opposing member 15 and the trestle 13 is actuated by bearings of known type, only illustrated schematically in FIG. 5.

Again with reference to FIG. 5, the machine 1 comprises a succession 29 of motion transmission units defining a kinematic chain such as to impart to the shoes 27, 28 a rotation about the axis R which is equal and opposite to that of the trestle 13, in such a way as to make the shoes 27, 28 substantially rotatably stationary relative to the supporting structure 2 of the machine 1.

The above-mentioned succession 29 of motion transmission units comprises an upper toothed wheel 30 rotatably integral with the trestle 13, a lower toothed wheel 31 rotatably integral with the shoes 27, 28, and a motion transmission shaft 32.

The above-mentioned succession 29 also comprises two flexible motion transmission units 33 each of which is designed to kinematically connect a respective toothed wheel 30, 31 with a respective end of the shaft 32 at which ends are located as many toothed wheels 32*a*, 32*b*.

The transmission ratio existing between the upper toothed wheels 30, 32*a* is equal to, in absolute terms, that between the lower toothed wheels 31, 32*b*; thus, a rotation of the trestle 13 about the axis R determines an equal and opposite rotation of the shoes 27, 28 about the same axis R. This equal and opposite rotation makes the shoes 27, 28 defining the opposing member 15 substantially stationary relative both to the supporting structure 2 of the machine 1 and to the shelf 9 on which the panels being processed, not illustrated, slide.

The above-mentioned succession 29 of motion transmission units defines, for the machine 1, actuator means to keep the shoes 27, 28 substantially stationary relative the axis R during the rotation of the trestle 13 around the axis R.

According to a variant embodiment of the invention illustrated in FIG. 7, the above-mentioned actuating means comprise a second electric motor 34 designed to guarantee to the opposing member 15 a rotation about the axis R equal and opposite to that of the trestle 13, in combination with the above-mentioned first electric motor 35. This variant embodiment therefore replaces the above-mentioned succession 29 of motion transmission units defining the kinematic chain with an electric axis, meaning the introduction of the second motor 34 to actuate a synchronised and opposite movement of the shoes 27, 28 compared with that of the trestle 13.

Figure 8:
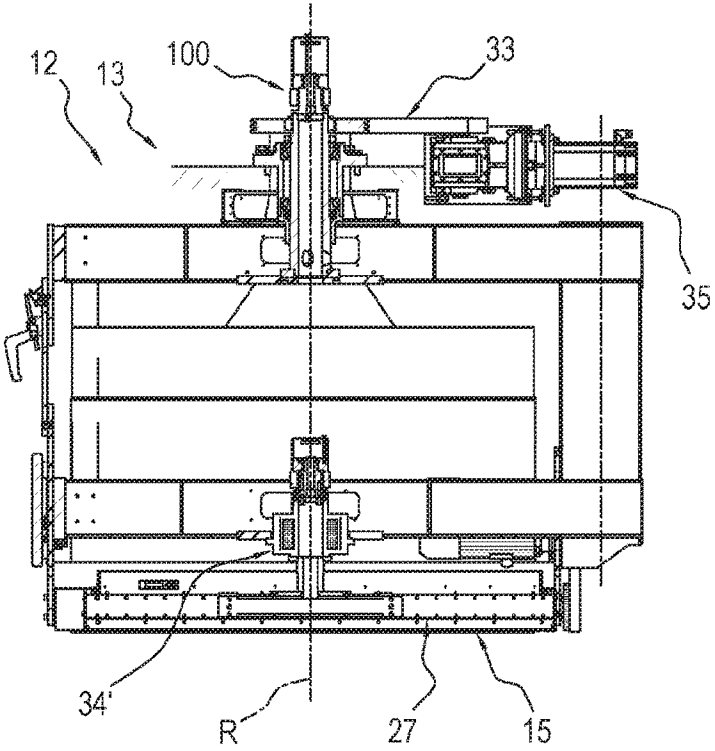
FIGS. 7 and 8 illustrate, in respective cross section views similar to that of FIG. 5, two variant embodiments of the sanding machine according to the previous drawings.

According to the further variant embodiment of this invention illustrated in FIG. 8, the above-mentioned actuating means comprise a second electric motor 34' of the hollow axis type, positioned concentrically with the axis R and designed to generate the above-mentioned rotation of the opposing member 15, described above with reference to the alternative embodiment illustrated in FIG. 7.

Figure 2:
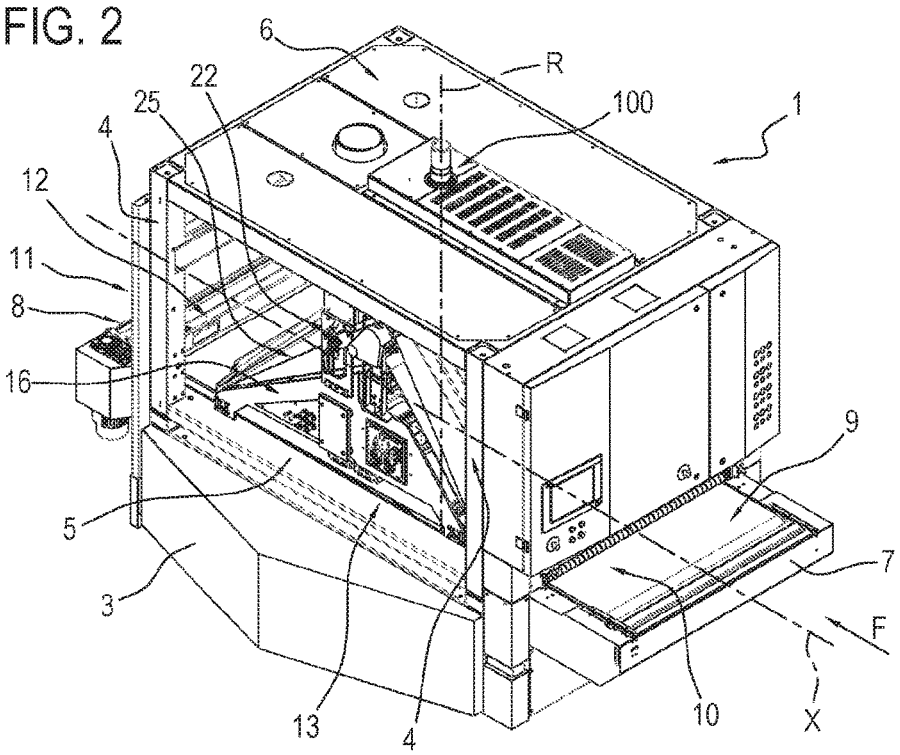
FIG. 2 is a schematic perspective view from above of the sanding machine of FIG. 1.

In use, in the machine 1 according to this invention the above-mentioned and not illustrated panels to be sanded are inserted through the inlet opening 10 in the direction of the arrow F illustrated in FIG. 2.

The panels, already at the first projecting portion 7, are therefore supported by the shelf 9 which, as mentioned, advantageously comprises the upper branch of a conveyor belt having the purpose of moving forward the panels along the above-mentioned direction X.

Below the shelf 9, advantageously made perforated, there are a plurality of different suction zones, not illustrated, designed to hold in position the above-mentioned panels during the processing.

In other words, the panel being processed is between the shelf 9 and the sanding belt 14, below the shoes 26, 27. In this position it is held against the shelf 9 by the suction exerted on its lower surface by the above-mentioned and not illustrated suction zones.

In short, the suction zones are chambers facing above the belt defining the shelf 9, the chambers being selectively activatable in such a way as to define a suction area as a function of the area occupied on the shelf 9 by the panel being processed.

The upper surface of the above-mentioned and not illustrated panels enters into contact with the sanding belt 14 which exerts on the surface of the panel a relative abrasive action.

Although the panel being processed enters into contact with the belt 14 already close to the inlet opening 10 it is in reality, as mentioned, basically subjected to an effective sanding action at the shoes 26, 27.

It is in effect close to the shoes 26, 27 that the belt 14 is effectively kept in contact with the surface of the panel and can therefore exert its best sanding action.

The shoes 26, 27 are made, in substantially known manner, with electronic activation comprising a plurality of sectors adjacent along their direction of extension.

A pneumatic or hydraulic actuator which is able to guarantee a perfect approach of each sector to the upper surface of the panel being processed is operatively connected to each sector. This sectioning of the shoes 26, 27 guarantees the possibility of also effectively processing panels with upper surfaces which are not flat.

A version of the machine according to this invention, not illustrated, which has lower performance levels but is still functional for less refined processing, may be performed using prior art shoes 26, 27 such as rigid ones or with a synchronous action in unison across the full width of the processing.

As mentioned, the trestle 13 is designed to rotate about the respective axis R and the rotation is actuated during the processing of the panels.

In other words, the rotation of the trestle 13 about the axis R is not a positioning rotation but a continuous rotation which generates an actual processing movement.

In effect, the rotation about the axis R of the trestle implies a rotation of the belt 14 which at the same time also completes its typical movement in a loop fashion around the rollers 17, 18.

The combination of the two above-mentioned movements of the belt 14 defines the processing motion.

FIGS. 6*a* to 6*d* illustrate different moments of the rotation of the trestle 13 about the axis R.

In FIGS. 6*a* to 6*d*, in its loop movement around the rollers 17, 18, the belt 14 has a tangential speed, the direction of which is indicated by the arrow V.

As mentioned, the relative speed of the belt 14 with respect to the panel—to be considered instantaneously stationary—is given by the combination of the tangential speed with the rotational speed of the trestle about the axis R, indicated in the drawing with the curved arrow C.

Figure 9:
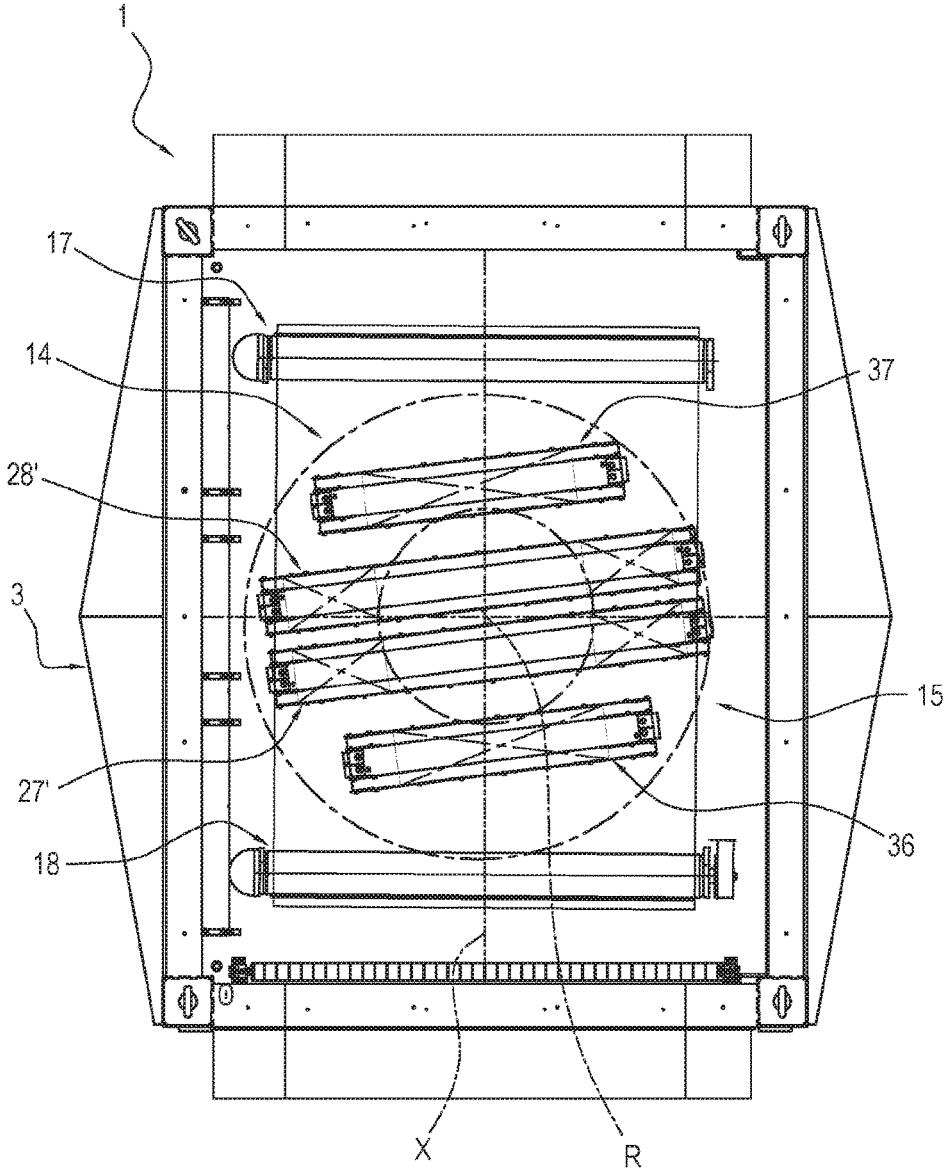
FIG. 9 illustrates a view from above with some parts cut away and other parts transparent to better illustrate others of another variant embodiment of the sanding machine according to this invention.

In the variant embodiment of the machine 1 illustrated in FIG. 9, the opposing member 15 comprises four pads 27', 28', 36, 37 of which the first two substantially similar to the already described shoes 27, 28, whilst the other two 36, 37 are positioned respectively upstream and downstream of shoes 27', 28', according to the feed direction of the panels.

In a similar fashion to the embodiments introduced above, the shoes 27', 28', 36, 37 are designed to push the sanding belt 14 against the above-mentioned and not illustrated panel to be processed.

A distinctive feature of the embodiment of the machine illustrated in FIG. 9 is to provide different pressure portions in the above-mentioned pads 27', 28', 36, 37 (marked with respective crosses in the drawing) such as to define, in combination with the rotation of the trestle 13 about the axis R, a operating zone having the shape of a circular crown.

In other words, the operating zone in the form of a circular crown, delimited by way of an example in FIG. 9 by two concentric circumferences drawn with a dashed line, is defined by the combination, as mentioned, of the rotation of the trestle 13 and the above-mentioned portions of different pressure, to optimise the consumption of the sanding belts 14.

This optimum consumption of the belt 14 has been experimentally proven and derives basically from the fact that the abrasive grains of the belt are subjected to a reduced stress relative to the existing operational techniques.

This invention brings important advantages.

The above-mentioned combination in the movement of the sanding belt 14 with respect to the panel being processed allows the abrasive effects generated on the surface of the panel to be rendered uniform, creating a surface finish free of predominant tracks due to the continuous crossing of the signs of sanding and implementing an abrasion-satin finishing in every direction.

More specifically, thanks to this double continuous movement, for example, an irregularity present on the belt not will cause any linear groove on the surface of the panel since the relative position of the belt and the panel is being continuously modified.

Rotary cross sanding in any direction thus has new finishing standards on each surface, even of a metal type such as sheets and laminates made of stainless steel, and guarantees a lower roughness compared with the results with traditional processing technologies.

A further advantage linked to the particular movement of the belt according to this invention is due to the possibility of effectively processing panels or wooden elements with grains oriented in a different fashion since, thanks to the rotation about the axis R, the belt 14 is located, in succession, in position to perform an effective processing of grains however they oriented.

This is the case, for example, of the sashes of windows or the like, the wooden frames of which may have—if processed with the prior art machines—the typical scratching against the grain. The machine according to this invention, thanks, as mentioned, to the possibility of performing the above-mentioned sanding in any direction, easily overcomes this drawback.

The invention claimed is:

1. A sanding machine for sanding a panel, comprising:
- a supporting structure,
- a sanding unit mounted on the supporting structure,
- a supporting surface for supporting and sliding of the panel located beneath the sanding unit and along which the panel is fed in a predetermined panel feed direction;
- the sanding unit comprising a trestle supporting a sanding belt,
- the trestle comprising a plurality of rollers having respective axes parallel to the supporting surface,
- the sanding belt being endless and looped around the plurality of rollers, one of the plurality of rollers being motorized to move the sanding belt during the sanding of the panel,
- the sanding unit further comprising an opposing member to force the belt against the panel to be sanded,
- wherein the trestle is rotatable about an axis perpendicular to the supporting surface and intersecting the supporting surface,
- the sanding unit comprising a motor for rotating the trestle about the axis;
- wherein the motor is configured to continuously rotate the trestle about the axis in such a way as to rotate the sanding belt to condition a relative processing motion between the sanding belt and the panel, the rotation of the trestle about the axis being a continuous rotation which generates an actual processing movement.

2. The sanding machine according to claim 1, wherein the opposing member comprises at least one shoe rotatably connected to the trestle, and an actuating system including a second motor to keep the at least one shoe substantially stationary relative to the axis during the rotation of the trestle about the axis.

3. The sanding machine according to claim 2, where the motor comprises a first electric motor, wherein the actuating system further comprises a motion transmission shaft connecting the second motor and the at least one shoe to impart to the at least one shoe a rotation equal and opposite to that of the trestle so that the at least one shoe remains substantially rotatably stationary relative to the supporting structure.

4. The sanding machine according to claim 3, wherein the actuating system further an upper toothed wheel integral with the trestle, a lower toothed wheel integral with the at least one shoe, and two flexible motion transmission members each connecting one of the upper and lower toothed wheels to a respective end of the motion transmission shaft.

5. The sanding machine according to claim 1, where the motor comprises a first electric motor, wherein the actuating system comprises a second electric motor for rotating the at least one shoe relative to the trestle so that the at least one shoe remains substantially rotatably stationary relative to the structure.

6. The sanding machine according to claim 1, and further comprising a drive belt for driving the sanding belt, the sanding belt being looped round an outside of the drive belt.

7. The sanding machine according to claim 2, wherein the at least one shoe is mounted transversely to the panel feed direction and spaced from the axis.

8. The sanding machine according to claim 2, wherein the at least one shoe comprises two shoes spaced from each other and mounted on opposite sides of the axis, along the panel feed direction.

9. The sanding machine according to claim 1, wherein the trestle has a frame being C-shaped, with a lower arm and an upper arm to allow insertion of the sanding belt, and openable latch for connecting the upper and lower arms to stiffen the frame during machine operation.

10. The sanding machine according to claim 9, wherein the openable latch comprises a controllable fastening member connected to one end of the lower and upper arms and a hook connected to a corresponding end of the other of the lower and upper arms to engage the controllable fastening member, and an adjuster for adjusting a distance between the ends of the lower and upper arms.

11. A method for sanding a panel, comprising steps of:
- providing a sanding machine comprising:
  - a supporting structure,
  - a sanding unit mounted on the supporting structure,
  - a supporting surface for supporting and sliding of the panel located beneath the sanding unit and along which the panel is fed in a predetermined panel feed direction;
  - the sanding unit comprising a trestle supporting a sanding belt,
  - the trestle comprising a plurality of rollers having respective axes parallel to the supporting surface,
  - the sanding belt being endless and looped around the plurality of rollers, one of the plurality of rollers being motorized to move the sanding belt during the sanding of the panel, the sanding unit further comprising an opposing member to force the belt against the panel to be sanded, wherein the trestle is rotatable about an axis perpendicular to the supporting surface and intersecting the supporting surface, the sanding unit comprising a motor for rotating the trestle about the axis;

wherein the motor is configured to continuously rotate the trestle about the axis in such a way as to rotate the sanding belt to condition a relative processing motion between the sanding belt and the panel, the rotation of the trestle about the axis being a continuous rotation which generates an actual processing movement;

feeding the panel to be sanded on the supporting surface of the machine, setting in ring motion the sanding belt mounted on the trestle, setting the trestle, and the sanding belt supported by the trestle, in rotation about the axis so that the panel engages the sanding belt.

12. A sanding machine for sanding a panel, comprising:

a supporting structure, a sanding unit mounted on the supporting structure, a supporting surface for supporting and sliding of the panel located beneath the sanding unit and along which the panel is fed in a predetermined panel feed direction;

the sanding unit comprising a trestle supporting a sanding belt, the trestle comprising a plurality of rollers having respective axes parallel to the supporting surface, the sanding belt being endless and looped around the plurality of rollers, one of the plurality of rollers being motorized to move the sanding belt during the sanding of the panel, the sanding unit further comprising an opposing member to force the belt against the panel to be sanded, wherein the trestle is rotatable about an axis perpendicular to the supporting surface and intersecting the supporting surface, the sanding unit comprising a motor for rotating the trestle about the axis;

wherein the opposing member comprises at least one shoe rotatably connected to the trestle, and an actuating system including a second motor to keep the at least one shoe stationary relative to the axis during the rotation of the trestle about the axis.

* * * * *